United States Patent [19]

Koiner et al.

[11] Patent Number: 4,952,176

[45] Date of Patent: Aug. 28, 1990

[54] ELECTRICAL COUPLING DEVICE

[75] Inventors: Josef Koiner, Pommelsbrunn; Helmut Steinhardt, Nuremburg, both of Fed. Rep. of Germany

[73] Assignee: TRW Daut & Rietz GmbH, Nuremberg, Fed. Rep. of Germany

[21] Appl. No.: 353,644

[22] PCT Filed: Aug. 1, 1988

[86] PCT No.: PCT/DE88/00475

§ 371 Date: Apr. 25, 1989

§ 102(e) Date: Apr. 25, 1989

[87] PCT Pub. No.: WO89/02167

PCT Pub. Date: Mar. 9, 1989

[30] Foreign Application Priority Data

Aug. 28, 1987 [DE] Fed. Rep. of Germany ..... 3728733
Feb. 25, 1988 [DE] Fed. Rep. of Germany ..... 3805897

[51] Int. Cl.[5] ..... H01R 13/629; H01R 13/645

[52] U.S. Cl. ..... 439/681; 439/372; 439/376

[58] Field of Search ..... 439/152, 153, 155, 157, 439/160, 341, 338, 372, 376, 680, 681, 677

[56] References Cited

FOREIGN PATENT DOCUMENTS 3407725 2/1984 Fed. Rep. of Germany ..... 439/372
1413232 12/1965 France .

*Primary Examiner*—Eugene F. Desmond
*Assistant Examiner*—Walter G. Hanchuk
*Attorney, Agent, or Firm*—Collard, Roe & Galgano

[57] ABSTRACT

An electric coupling device comprises a test contact strip fastened to an appliance frame, a housing which can be mounted in a space in the appliance frame by means of two pivot pins interspaced along the same axis and which houses a socket terminal strip, levers hinged to the appliance frame and which can be inserted with sliding block cranks in slotted grooves in the housing for swivelling the housing to the appliance frame, and coding means arranged on the appliance frame and housing. To ensure simple, reliable and variable coding, between the pivot pins (11) the socket terminal strip housing (3) has a row of previously made slots (30) with notched contours and open front ends in the direction of plugging, and between the pivot pins (12) the appliance frame (1) has at least one coding pin (31) which can be interchangeably and firmly inserted in openings in the appliance frame and introduced into slots (30) in the socket terminal strip housing (30).

8 Claims, 4 Drawing Sheets

ELECTRICAL COUPLING DEVICE

The invention relates to an electrical coupling device with a blade strip rigidly arranged on an equipment frame, with a casing adapted for suspension in bearings of the equipment frame by means of two articular pins equiaxially disposed next to each other with a spacing in between, and with a sleeve strip accommodated in such casing and linked on the equipment frame and adapted for engaging link blocks in link grooves of the casing for swinging the latter against the equipment frame, as well as with coding means arranged on the equipment frame and casing.

For coding purposes, it is known in connection with electrical couplings of this type (EP 0 119 951 Al) to arrange coding pieces within the zone of the rotatable mount of the casing and equipment frame, such coding pieces meshing on such casing and frame. For this purpose, the coding piece provided on the one coupling part has a cylinder section adapted for swinging into a coding piece of the other coupling part, such other coding piece having a hollow cylindrical section. Aside from the fact that it is difficult to produce the coding pieces, the latter require complicated measures for fastening them on the coupling parts. Moreover, changing the coding requires considerable installation work.

The problem of the invention is to create a simple and safe coding for coupling devices that is also variable.

According to the invention, this is accomplished in that the casing of the sleeve strip has slottings prepared next to each other between the articular pins on contours that can be broken out, such slottings having open ends in front in the plugging direction, and that the equipment frame has at least one coding pin supported between the bearings of the articular pins, such coding pin being exchangeably inserted in openings of the equipment frame and adapted for engaging slottings of the casing of the sleeve strip. Such casing of the sleeve strip is preferably formed by a flat strip between the two articular pins and has slottings prepared by contours which can be broken out. In this way, the coding means for coding the coupling parts can be produced in a simple way and without the disadvantage of having to enlarge the frame of the equipment and/or casing. Furthermore, the prepared slottings and the coding pin can be formed on tools without great expenditure.

For embodying the coupling device, provision is made, furthermore, that each of the link grooves has a conically tapering link part with a transversely extending link groove part, such tapered parts being disposed at the ends where the link blocks of the levers are inserted, and that such transversely extending link groove parts have two curved retractions disposed one after the other as catches for the prelocking and locking positions. When the casing of placed against the frame of the equipment, partial swinging of the casing in connection with the twin levers supporting the link blocks permits prelocking of the casing by engagement of the link blocks in the one retraction. From this prelocked position, the casing can then be locked on the frame of the equipment by swinging the twin levers down further and shifting the link blocks into the other retraction or catch. The retractions for the locking position usefully extend ahead of the vertical line of connection of the center axis of the pins to the equipment frame. In this way, an excess stroke is accomplished for the twin levers , which excludes unintentional automatic disengagement.

Finally, provision is made that the two levers are twin levers with lever arms of varying lengths, and that such twin levers are connected with each other by a bridge, whereby the levers are supported on the frame of the equipment by means of journals and the short arms of the levers support the link blocks. According to a preferred embodiment, the lever arms and the bridge are formed by a single-piece shaped part, and the pins and/or the link blocks are formed by deep-drawn attachments arranged on the lever arms for enhancing the stability.

For the purpose of preventing the pins from unintentionally moving out of the pin bearings, provision is made that a flexible flap is cut on each of the attachments forming the pins, such flaps immersing in the annular grooves joining the pin bearings and serving as axial supports for the twin levers.

Furthermore, axial fixing of the twin levers on the equipment frame can be accomplished by providing each of the attachments forming the pins with a bulging, and each of the pin bearings with a passage for such bulgings, such passages being displaced next to the pin bearings to correspond with the operating and resting positions of the twin levers. The attachments can be inserted in or removed from the pin bearings by simply aligning the bulgings and their associated passages.

The invention is explained in greater detail in the following with the help of the embodiment shown in the drawing, in which.

Figures 1, 2, 3:
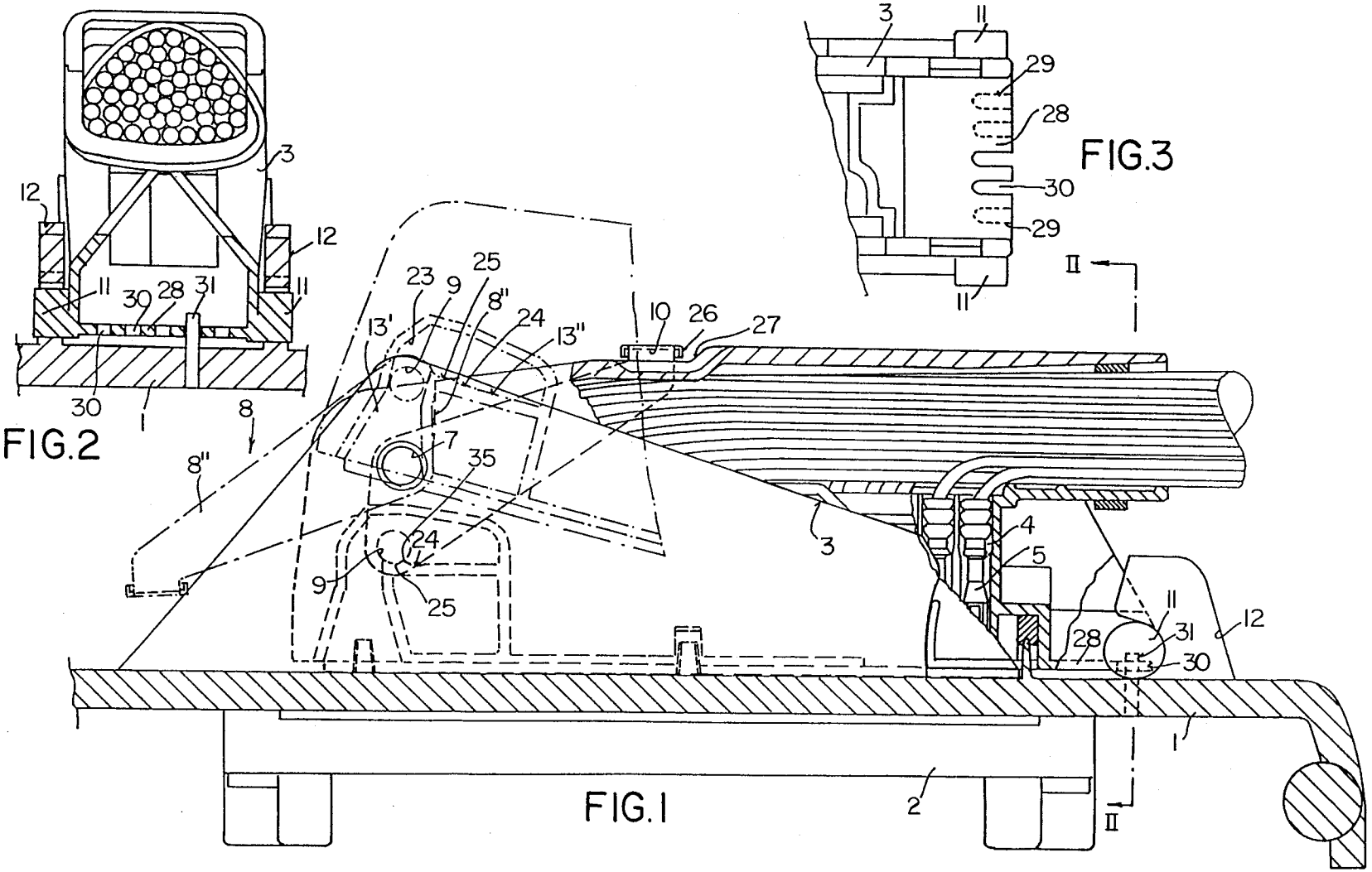
FIG. 1 shows a lateral and partly sectional view of a coupling device.
FIG. 2 is a sectional view with a cut along line II—II in FIG. 1.
FIG. 3 is a top view of a part of a casing.

In the FIGURES, reference numeral 1 denotes an equipment framesupporting a multi-pole blade strip 2. Such a frame may be arranged, for example in a motor vehicle. Reference numeral 3 denotes a sleeve strip housing receiving the sleeves 5 in the recesses 4 (FIG. 4), such sleeves being adapted to contact the blade pins 2' of the blade strip 2. The equipment frame 1 has the parallel lateral cheeks 6 accommodating the sleeve strip housing 3 between each other. The twin levers 8 with the lever arms 8' and 8'', such arms being of different lengths, are linked on the lateral cheeks 6 by means of the pins 7. Each of the shorter lever arms 8' supports another pin 9 serving as the link block, and the long lever arms 8'' are rigidly connected with each other at their free ends by a bridge 10. The twin levers 8 are swingable from a dash-dotted release position for the sleeve strip housing 3 into a fully drawn coupling position, and vice versa. The sleeve strip housing 3 is supported pivoting on the articular pin bearings 12 of the equipment frame 1 by means of the pivot pins 11.

Figure 4:
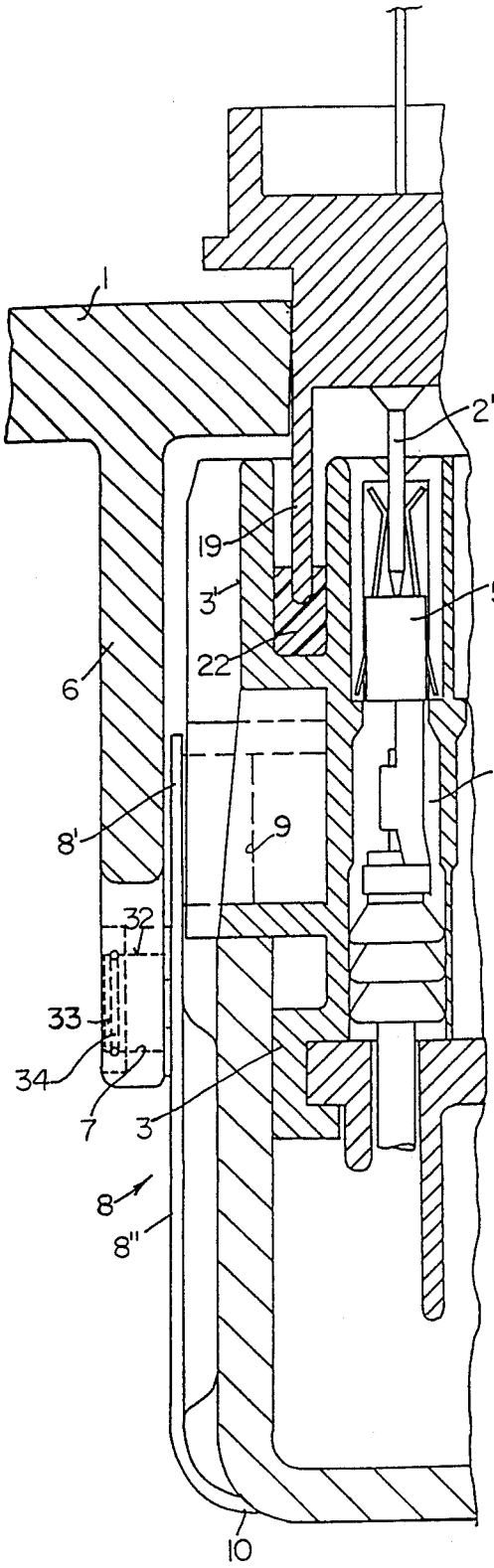
FIG. 4 is a sectional view of part of a coupling device.
Figure 5:
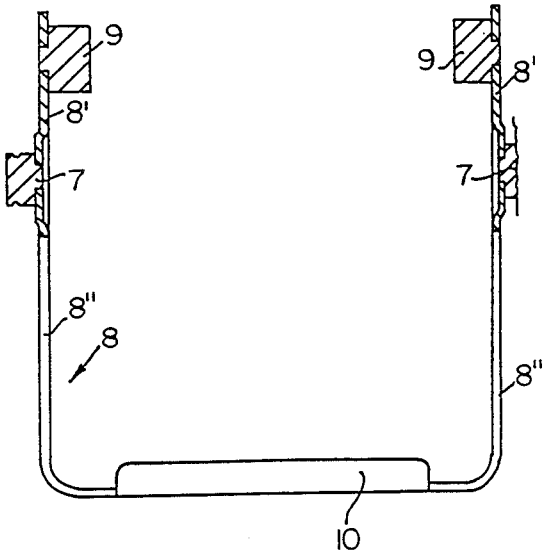
FIG. 5 shows two twin levers with link blocks, in a top view.
Figure 6:
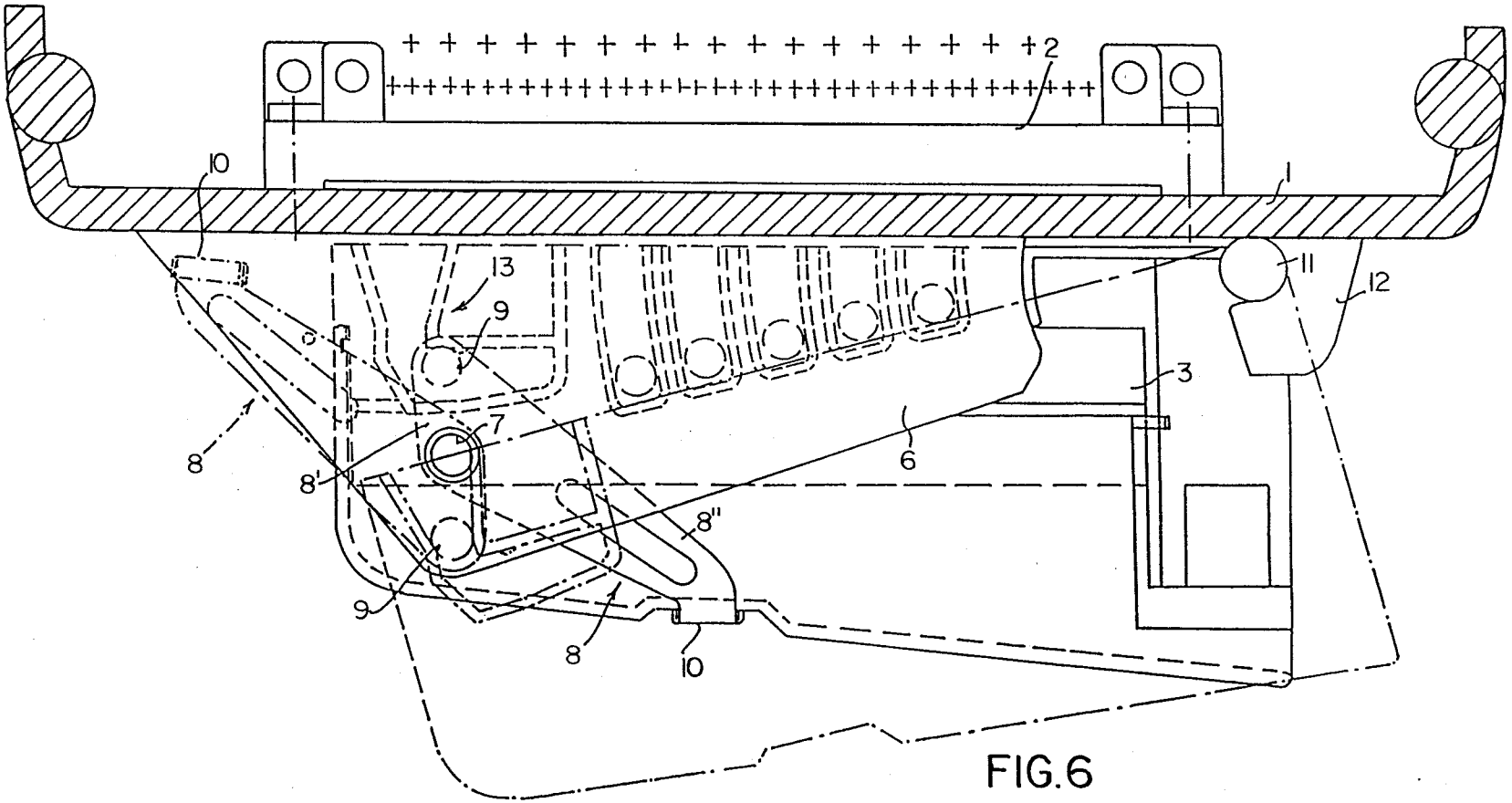
FIG. 6 is a lateral view of a coupling device.
Figure 7:
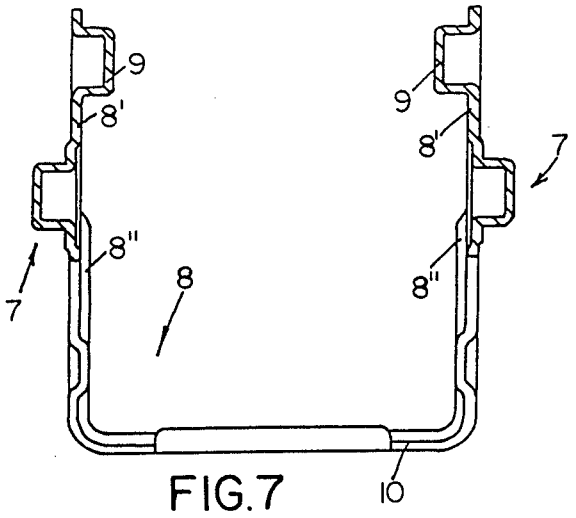
FIG. 7 is a partly sectional view of a shaped part with pins and attachments, such part being formed by twin levers.

FIGS. 4 and 5 show that the pins 7 of the twin levers 8 are supported in the recesses 32 of the lateral cheeks 6, such recesses having an enlarged inside diameter in the zone of the free ends of the pins 7. Each of the pins 7 so accessible receives in a groove 33 a snap ring 34 for axially fixing the lever arms 8', 8" on the lateral cheeks 6.

When the pivot pins 11 are inserted or pushed into the pivot pin bearings, the sleeve strip housing 2 for assumes the dash-dotted position in FIG. 1. By subsequent swinging of the sleeve strip housing 3 in the direction of the equipment frame 1, the pins 9 in the conical link groove parts 13' are displaced, causing the pins 9 to run up on the slopes 23, which is turn causes the twin levers 8 to partly swing clockwise The pins 9 come to cooperate with a retraction 24 and the sleeve strip housing 3 is kept prelocked on the equipment frame 1. When the twin levers 8 are swung further down clockwise, the pins 9 move across the part 13" and force the sleeve strip housing 3 into the coupling position on the frame 1 as shown in FIG. 1. In this position, the pins 9 engage the other retractions 25. By arranging such retractions 25 ahead of vertical line of connection between the center axes of the pins 7 and the equipment frame 1, an excess stroke is created or produced, leading to locking and preventing any automatic detachment of the sleeve housing 3 from the equipment frame 1. When the sleeve housing and the frame are in the coupled position, the twin levers 8 engage a recess 27 of the casing 3 with an actuating attachment 26. By sliding or pushing a suitable tool, e.g. a screwdriver, into the recess 27, the twin lever 8 can be swung back and the sleeve strip housing 3 can be removed from the equipment frame 1. The elevations 35 remaining between the retractions 24, 25 lead to a noticeable resistance as they cooperate with the pins 9, such resistance having the nature of a pressure point The sleeve strip housing 3 has flat strip 28 between the two pivot pins 11, such flat strip having a number of slottings 30 which can be broken out on the prepared contours 29. Such slottings 30 are rigidly associated with at least one pin 31 on the equipment frame 1, such pin being exchangeable. Coding of the sleeve strip casing 3 is accomplished by having the slottings 30 and the pins 31 cooperate with each other. Of course, any desired number of pins 31 can be associated with the same number of slottings 30.

Figure 9:
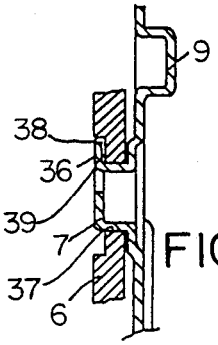
FIG. 9 is a sectional view of a pin according to one embodiment.
Figure 8:
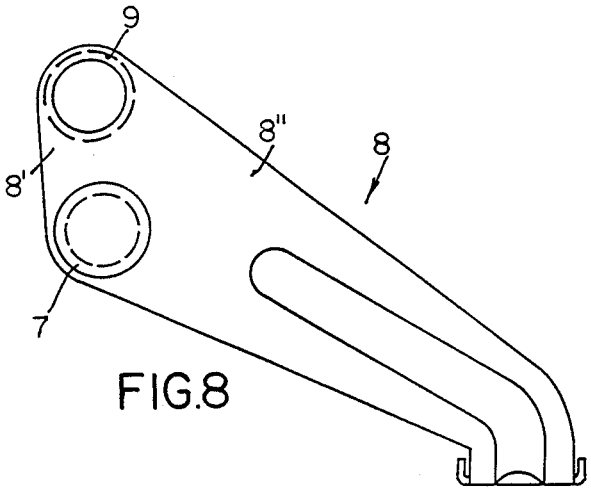
FIG. 8 is a lateral view of a shaped part formed by twin levers.
Figure 10:
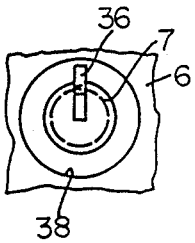
FIG. 10 shows a front view of a pin.

In the embodiments according to FIGS. 6 to 12, the pins 7 and the pins 9 are formed by deep-drawn attachments (FIG. 7) and hence form one single piece with the lever arms 8', 8". In FIGS. 9 and 10, a flap 36 is cut on each of the pins 7. By bending such flaps back, the pins 7 are prevented from unintentionally sliding out of the pin bearings 37. In order to avoid that sections of the pins 7 project beyond the lateral cheeks 6, the flaps 38 preferably immerse in the annular grooves 38 with play and come to rest on the inner limiting surfaces 39 of the annular grooves 38.

Figure 11:
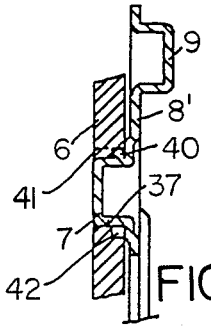
FIG. 11 is a sectional view of a pin of another embodiment.
Figure 12:
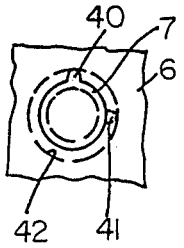
FIG. 12 is a front view of the pin according to FIG. 11.

In the embodiment according to FIGS. 11 and 12, each of the pins 7 has an attachment or bulging 40 within the zone of the circumferential surface. Such attachments or bulgings inmerse in the cut annular grooves 42 via the passages 41, the latter being displaced relative to the release and operating positions of the strip housing 3, This permits free swinging of the twin levers 8. The pins 7 are axially fixed on the lateral cheeks with play by means of the attachments 40 and the annular grooves 42, which prevents the pins 7 from unintentionally sliding from the pin bearings 37.

We claim:

1. Electrical coupling device with a blade strip rigidly arranged on an equipment frame, a casing adapted for suspension in bearings of the frame by means of two pivot pins formed equiaxially next to each other with a spacing in between; with a sleeve strip accommodated in such casing, and with levers for swinging the casing against the equipment frame, such levers being linked on the equipment frame and adapted to engage link grooves of the casing with link blocks, as well as with coding means arranged on the equipment frame and casing, characterized in that the sleeve strip casing (3) has slottings (30) prepared next to each other between the pivot pins (11) on contours designed to be broken out, such slottings having open ends in front in the plugging direction; and that the equipment frame (1) supports at least one rigidly and exchangeably inserted coding pin (31) between the pivot pin bearings (12), such coding pin being adapted to engage slottings (30) of the sleeve strip casing (3).

2. Electrical coupling device as defined in claim 1, characterized in that the sleeve strip casing (3) is formed between the two pivot pins (11) by a flat strip (28), and that the latter has slottings (30) prepared by contours designed to be broken out.

3. Electrical coupling device as defined in claim 1, characterized in that the link grooves have a conically tapered link groove part (13') joined by a transversely extending link groove part (13"), such parts (13') being disposed at the ends at which the link blocks (9) of the levers (8', 8") move into the link grooves, and tapered in the direction of insertion; and that the transversely extending link groove parts (13") have two curved retractions (24, 25) disposed one after the other as catches for the link blocks (9) for the prelocking and locking positions.

4. Electrical coupling device as defined in claim 3, characterized in that the retractions (25) forming the locking position are formed ahead of the vertical line of connection of the center axis of the pins (7) to the equipment frame (1).

5. Electrical coupling device as defined in claim 1, characterized in that the two levers (8) are designed as twin levers with lever arms (8', 8") of varying lengths and connected with each other by a bridge (10), and that the levers (8) are supported on the equipment frame by means of pins (7) and have the link blocks (9) on the short lever arms (8').

6. Electrical coupling device as defined in claim 5, characterized in that the lever arms (8', 8") and the bridge (10) are formed by a single-piece shaped part, and the pins (7) and/or the link blocks (9) are formed by deep-drawn attachments arranged on the lever arms (8', 8").

7. Electrical coupling device as defined in claim 6, characterized in that a; flexible flap (36) is cut on each of the attachments forming the pins (7), such flaps immersing in annular grooves (38) joining the pin bearings (37) for receiving the pins (7), and serving as axial supports for the twin levers (8).

8. Electrical coupling device as defined in claim 6 characterized in that the attachments forming the pins (7) each have a bulging (40), and that the associated pin bearings (37) each have a passage opening (41) for the bulgings (40) of the attachments, such passages being displaced relative to the operating and resting positions of the twin levers (8) and disposed adjoined with the pin bearings (37).

* * * * *